United States Patent [19]

Bai et al.

[11] Patent Number: 4,673,777

[45] Date of Patent: Jun. 16, 1987

[54] MICROBEAM SENSOR CONTACT DAMPER

[75] Inventors: Monty W. Bai, Scottsdale; John D. Titus, Phoenix; Louis P. Farace, Mesa, all of Ariz.

[73] Assignee: Motorola, Inc., Schaumburg, Ill.

[21] Appl. No.: 872,072

[22] Filed: Jun. 9, 1986

[51] Int. Cl.[4] ..... H01H 35/14; H01H 57/00

[52] U.S. Cl. ..... 200/61.45 R; 200/61.48; 200/181

[58] Field of Search ..... 200/61.45 R, 61.48–61.51, 200/61.25, 83 B, 83 N, 181

[56] References Cited

U.S. PATENT DOCUMENTS

| | | | |
|---|---|---|---|
| 3,144,528 | 8/1964 | Pino | 200/61.45 R |
| 3,177,312 | 4/1965 | Clarke | 200/61.45 R |
| 3,413,497 | 11/1968 | Atalla | 200/181 X |
| 3,764,820 | 10/1973 | White et al. | 307/121 |
| 4,480,162 | 10/1984 | Greenwood | 200/340 X |
| 4,543,457 | 9/1985 | Petersen et al. | 200/83 N |

FOREIGN PATENT DOCUMENTS

| | | | |
|---|---|---|---|
| 1584914 | 2/1981 | United Kingdom | 200/181 |

OTHER PUBLICATIONS

K. E. Petersen; *IBM Tech. Disc. Bull.;* "Bistable Micromechanical Storage Element in Silicon", vol. 20, No. 12, May 1978, p. 5309.

K. E. Petersen; *IBM J. Res. Develop.;* "Micromechanical Membrane Switches on Silicon"; vol. 23, No. 4, Jul. 1979, pp. 376–385.

L. Holland et al; *IBM Tech. Disc. Bull.;* "Bottom Contact Micromechanical Switching Geometry"; vol. 21, No. 3, Aug. 1978, pp. 1207, 1208.

*Primary Examiner*—J. R. Scott

*Attorney, Agent, or Firm*—Raymond J. Warren

[57] ABSTRACT

The present invention consists of an apparatus for damping the movement of a microbeam sensor. The damping device consists of a gold plated chrome bar, or the like being placed, or fabricated, above the microbeam. This damper prevents excessive movement that could be caused from harmonic vibrations or the like.

8 Claims, 2 Drawing Figures

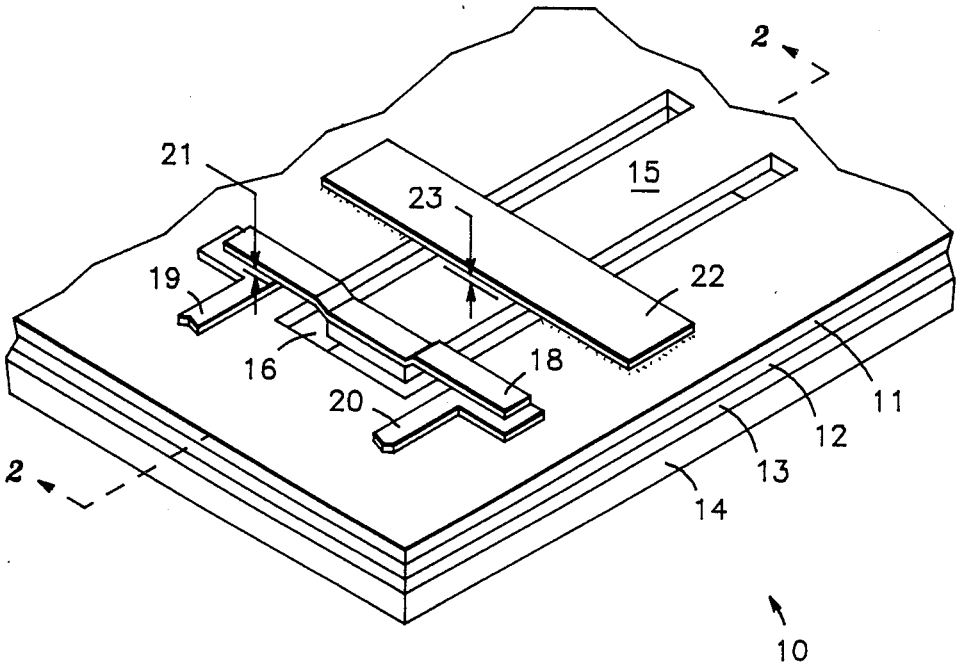
FIG. 1
FIG. 2
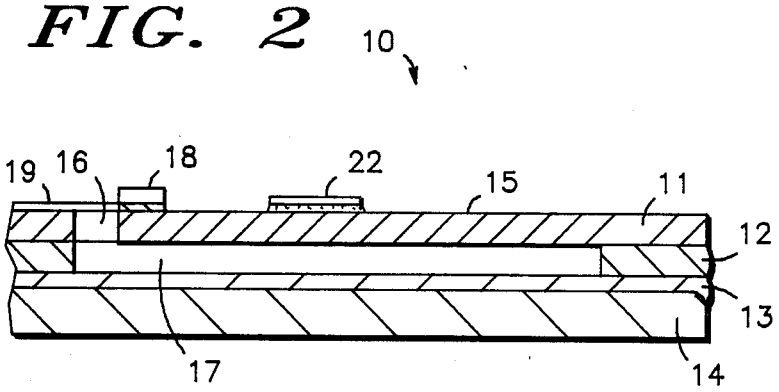

MICROBEAM SENSOR CONTACT DAMPER

BACKGROUND OF THE INVENTION

The present invention relates, in general, to microbeam sensors and, more particularly, to microbeam sensors used in high vibration environments.

Microbeam sensors are those such as described in U.S. Pat. No. 4,543,457 entitled "Microminiature Force-Sensitive Switch". FIGS. 7 and 8 of the U.S. Pat. No. 4,543,457 show a beam type arrangement is disclosed. A problem inherent in this type of arrangement is the accidental or unwanted contact of the beam with the associated connector. In a high vibration environment, contact can be accidentally made. In lower vibration environments the harmonic frequencies of the beam could cause contact to be made.

SUMMARY OF THE INVENTION

Accordingly, it is an object of the present invention to provide a microbeam sensor contact damper that overcomes the above deficiencies.

A further object of the present invention is to provide a microbeam sensor contact damper which prevents the microbeam from closing due to harmonic amplification by damping oscillations which exceed a predetermined amplitude.

Another object of the present invention is to provide a microbeam sensor contact damper which will prevent damage to the microbeam due to high shock in a reverse sensing direction.

Still another object of the present invention is to provide a microbeam sensor contact damper which is easily fabricated by existing silicon microminiature technologies.

The above and other objects and advantages of the present invention are provided by the microbeam sensor contact damper described herein.

A particular embodiment of the present invention consists of a microbeam sensor contact damper comprising: a silicon wafer having a microbeam defined therein adapted to move in a perpendicular relation with respect to said silicon wafer; and damper means for damping the movement of said microbeam, said damper having first and second ends coupled to said silicon wafer and disposed above said microbeam.

BRIEF DESCRIPTION OF THE DRAWINGS

FIG. 1 is a perspective view of a microbeam sensor embodying the present invention; and FIG. 2 is a cross-sectional view of the microbeam sensor as seen from line 2—2 of FIG. 1.

DETAILED DESCRIPTION OF THE DRAWINGS

Referring now to FIGS. 1 and 2, a microbeam sensor, generally designated 10, embodying the present invention is shown. As shown microbeam 10 consists of four layers 11–14. It should be noted that while four layers are shown, this device could have more or less than four layers depending upon the processing technique used. Layer 11 has a height of approximately 1.0 microns; layers 12 and 13 about 3.0 microns; and layer 14 about 5.0 microns.

A cantilevered beam 15 is formed by an opening 16 in layer 11. An opening 17 is also formed in layer 12 below beam 15 to allow movement of beam 15. A contact plate 18 is attached to an end of beam 15 opposite the hinged end. Contact plate 18 is configured to make contact with switch contacts 19 and 20 when the beam is deflected a predetermined distance equal to a gap 21 between contact plate 18 and switch contact 19. When beam 15 is deflected, resulting from contact with an external object or the like, by the amount of gap 21, typically on the order of 1.0 micron, contact plate 18 will complete a connection between switch contacts 19 and 20.

If the device containing microbeam 10 is subjected to external vibrations a harmonic motion can be generated in beam 15 that will cause contact plate 18 to couple switch contacts 19 and 20. In addition, if a force is exerted on beam 15 causing it to flex in the direction away from switch contacts 19 and 20, due to dropping the device containing microbeam 10, the resiliency of microbeam 10 can cause the beam to spring back and make contact plate 18 couple switch contacts 19 and 20. This is also known as reverse acceleration overload.

In order to prevent the undesired coupling of switch contacts 19 and 20, a damper 22 is provided. Damper 22 is disposed above layer 11 extending across microbeam 15 and opening 16. In FIG. 1, a gap 23 is shown between damper 22 and microbeam 15. Gap 23 has a maximum height defined by gap 21. Gap 23 should be less than gap 21 in order to prevent the harmonic from exceeding the distance of gap 21. By way of example if gap 21 were 1.0 microns, gap 23 may be set at 0.25 microns.

One embodiment of the present invention consists of damper 22 being made of a bar of chrome, or similar material, having a layer of gold, or the like, sputter deposited over a thin mask which prevents adhesion between the sputtered material and beam 15 and preserves a controlled gap that is less than gap 21.

There is no limit on the minimum of gap 23. In one embodiment damper 22 can be in contact with beam 15. In another embodiment, damper 22 can be exerting a force on beam 15 when microbeam 10 is at rest. This would result if beam 15 extended above the top plane of layer 11 while at rest and damper 22 were disposed across the top plane of layer 11.

As shown the present invention can prevent the microbeam from closing due to harmonic amplification or from spring action due to deflection in an upward direction. The present invention also prevents damage to microbeam 10 that can be caused if the deflection of beam 15 exceeds the tolerances of the material used to construct microbeam 10.

Thus, it is apparent to one skilled in the art that there has been provided in accordance with the invention, a device and method that fully satisfies the objects, aims and advantages set forth above.

While the invention has been described in conjunction with specific embodiments thereof, it is evident that many alterations, modifications, and variations will be apparent to those skilled in the art in light of the foregoing description. Accordingly, it is intended to embrace all such alterations, modifications and variations in the appended claims.

We claim:

1. A microbeam sensor contact damper comprising:

a first layer of a silicon wafer having an upper surface, a lower surface, and an opening disposed therethrough said first layer defining a microbeam having a first end and a second end opposite said first end, in said opening of said first layer of said silicon wafer, said first end of said microbeam extending from said first layer of said silicon wafer; and damper means for damping the movement of said microbeam, said damper means being coupled to said upper surface of said first layer of said silicon wafer and being disposed above said microbeam so that a gap exists between said damper means and said microbeam when said microbeam is at rest.

2. The microbeam sensor contact damper of claim 1 further comprising:

a second layer of said silicon wafer having an upper surface, a lower surface and an opening disposed therethrough, said upper surface of said second layer being coupled to said lower surface of said first layer and the opening of said second layer being disposed in a matching relation to the opening of said first layer; and a third layer of said silicon wafer having an upper surface, said upper surface being coupled to said lower surface of said second layer.

3. The microbeam sensor contact damper of claim 1 further comprising contact means being coupled to said microbeam and fixed contact means on the upper surface of the first layer of the silicon wafer.

4. The microbeam sensor contact damper of claim 1 where said damper comprises a gold plated chrome beam having a first end and a second end, said first and second ends being coupled to said upper surface of said first layer of said silicon wafer such that said silicon beam extends above said microbeam.

5. A microbeam sensor contact damper comprising:

a first layer of silicon wafer having an upper surface, a lower surface, and an opening disposed therethrough, said first layer defining a microbeam having a first end and a second end opposite said first end, in said opening of said first layer of said silicon wafer, said first end of said microbeam extending from said first layer of said silicon wafer;

damper means for damping the movement of said microbeam, said damper means being coupled to said upper surface of said first layer of said silicon wafer and being disposed above said microbeam so that a gap exists between said damper means and said microbeam when said microbeam is at rest;

a second layer of said silicon wafer having an upper surface, a lower surface and an opening disposed therethrough, said upper surface of said second layer being coupled to said lower surface of said first layer and the opening of said second layer being disposed in a matching relation to the opening of said first layer; and a third layer of said silicon wafer having an upper surface, said upper surface being coupled to said lower surface of said second layer.

6. The microbeam sensor contact damper of claim 5 further comprising contact means being being coupled to said microbeam and fixed contact means on the upper surface of the first layer of the silicon wafer.

7. The microbeam sensor contact damper of claim 5 where said damper comprises a gold plated chrome beam having a first end and a second end, said first and second ends being coupled to said upper surface of said first layer of said silicon wafer such that said silicon beam extends above said microbeam.

8. A microbeam sensor contact damper comprising:

a silicon wafer having a microbeam defined therein adapted to move in a perpendicular relation with respect to said silicon wafer; and damper means for damping the movement of said microbeam, said damper having first and second ends coupled to said silicon wafer and disposed above said microbeam.

* * * * *